United States Patent [19]

Costello

[11] 4,392,083

[45] Jul. 5, 1983

[54] RADIATION SHIELD FOR A CATHODE RAY TUBE

[75] Inventor: Louis B. Costello, Niles, Ill.

[73] Assignee: Teletype Corporation, Skokie, Ill.

[21] Appl. No.: 323,217

[22] Filed: Nov. 20, 1981

[51] Int. Cl.[3] ..... H01J 1/52

[52] U.S. Cl. ..... 315/85; 174/35 CE; 250/519.1; 313/479; 315/8; 335/214

[58] Field of Search ..... 315/85, 8; 250/519; 378/203; 455/300; 174/35 R, 102 SP, 35 CE; 313/479, 440; 335/214

[56] References Cited

U.S. PATENT DOCUMENTS

| | | | |
|---|---|---|---|
| 2,217,409 | 10/1940 | Hepp | 335/214 |
| 2,567,874 | 9/1951 | Cage | 313/85 |
| 2,623,923 | 12/1952 | Zimmerman | 174/35 CE |
| 3,824,515 | 7/1974 | Holman | 335/214 |
| 3,984,696 | 10/1976 | Collica et al. | 250/519.1 |

OTHER PUBLICATIONS

F. E. Terman, Sc.D., *Radio Engineers' Handbook,* pp. 132–134.

*Primary Examiner*—Harold A. Dixon
*Attorney, Agent, or Firm*—W. K. Serp; J. C. Albrecht

[57] ABSTRACT

A radiation shield 14 for a cathode ray tube 10 neck 16 includes a sleeve 24 of insulating material. Bonded to the inner surface 26 of the sleeve 24 are a plurality of elongated, coaxially oriented spaced conductive elements 30. Similarly, a plurality of elongated, coaxially oriented spaced conductive elements 32 are bonded to the outer surface 28 of the sleeve 24. The inner elements 30 are offset from the outer elements 32. A conductive ring 40 is connected to each of the inner 30 and outer 32 elements along one end of the sleeve 24 and to ground potential by a drain strap 44.

9 Claims, 5 Drawing Figures

RADIATION SHIELD FOR A CATHODE RAY TUBE

DESCRIPTION

1. TECHNICAL FIELD

This invention relates to a radiation shield for a cathode ray tube which attenuates electromagnetic radiation from the neck of the tube.

2. BACKGROUND ART

In the process of presenting a visual display on the face of a cathode ray tube, various signal and fixed voltage potentials are applied to the elements of the tube to generate and control an electron beam within the envelope of the tube. The beam is directed to sweep the face of the tube by horizontal and vertical magnetic deflection circuitry. As the beam traverses the face of the tube, the intensity of the electron beam is modulated by a video contact signal to produce the desired display pattern.

The video control signal is a relatively high frequency, high voltage electrical signal which is derived from a low impedance source. Present video control signals are in the order of twenty-one megahertz and there is pressure to increase the frequency of these signals in new display apparatus. The video signal typically carries black and white information along with one or more intermediate gray scale levels of information. Typically, the video control signal will swing in the order of forty volts. In such arrangements, there are substantial electromagnetic fields which radiate to the surrounding space and may be coupled to wiring and other circuitry of the display and reradiated into the space surrounding the apparatus. Such radiation may adversely affect the operation of other circuitry of the display and may adversely affect operation of other nearby apparatus. In the United States Federal Regulations there is defined permissible levels of electromagnetic radiation.

Positioned about the neck of the tube is a yoke coil through which flows relatively high current for generating the magnetic deflection fields. The magnetic fields penetrate the glass neck of the tube and serve to deflect the electron beam across the face of the tube in the desired pattern, e.g. a raster pattern.

Although a continuous conductive shield about the tube neck would greatly attenuate the fields generated by the video control signals, such a shield would adversely interfere with the magnetic deflection fields. The yoke's magnetic field would produce high eddy currents in such a shield and thus waste deflection energy as well as interfere with the desired deflection of the beam.

Heretofore, various shielding arrangements for a cathode ray tube have been suggested which generally include a rather complex and large metallic shield over the entire tube and yoke including a metallic screen over the face of the tube.

DISCLOSURE OF THE INVENTION

A radiation shield for the neck of a magnetic deflection cathode ray tube includes a sleeve of insulating material having an inner diameter greater than the outer diameter of the neck of the tube so as to facilitate positioning of the sleeve thereon. A plurality of first, conductive strips of material are bonded to the inner surface of the sleeve; and similarly, a plurality of second, conductive strips of material are bonded to the outer surface of the sleeve. Means are also included for connecting one end of each of the first and second conductive strips to a ground potential. Thus, the electromagnetic radiation from the tube is greatly attenuated while the magnetic field generated by the yoke is allowed to pass through the shield with relatively low attenuation.

Preferably, the first and second conductive strips are of a non-magnetic material. Additionally, the connecting means is in the form of a slit having substantially the diameter of the sleeve with the width of the slit being slightly greater than the total thickness of the sleeve. The sleeve is positioned into the slit after which the slit is compressed to complete an electrical connection between the conductive strips and the ring.

THE DRAWING

DETAILED DESCRIPTION

Figure 1:
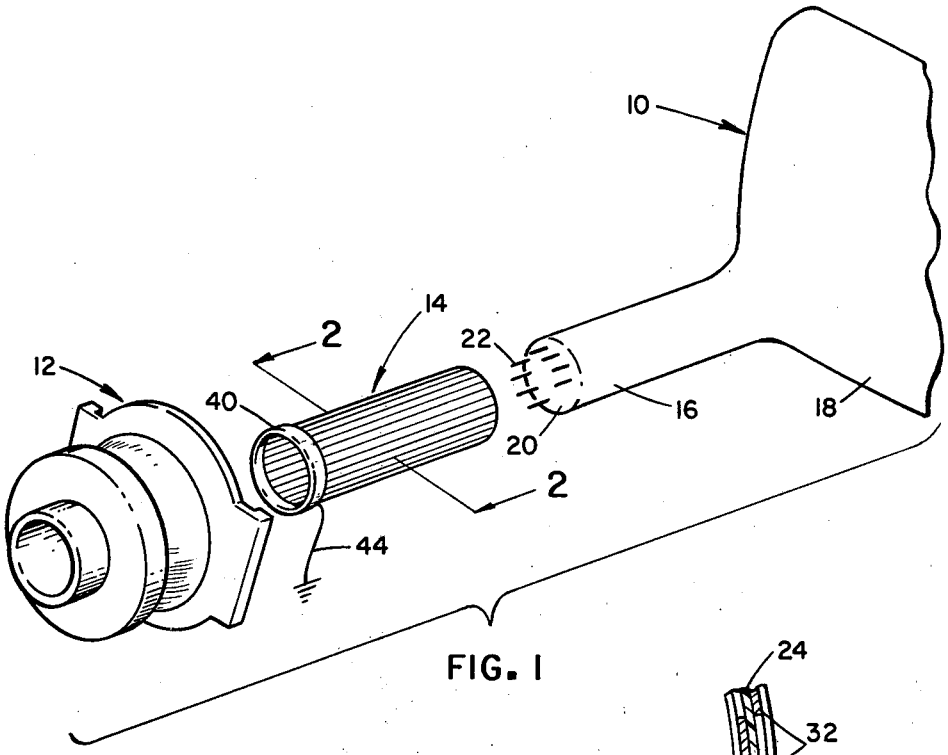
FIG. 1 is an exploded view of a cathode ray tube, a yoke and a radiation shield embodying certain features of this invention.
Figure 2:
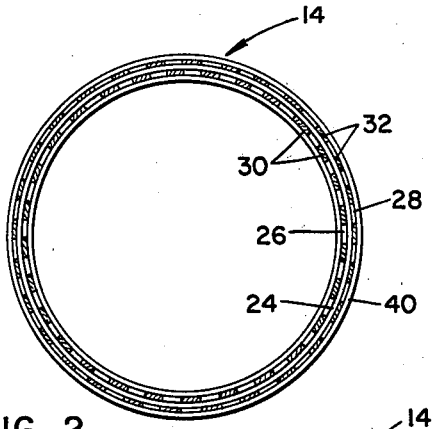
FIG. 2 is a full sectional view of the shield shown in FIG. 1 taken along the line 2—2.
Figure 3:
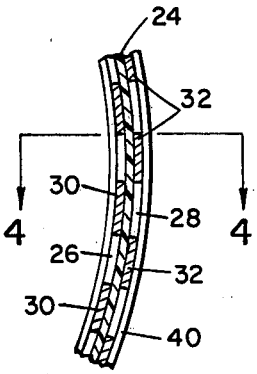
FIG. 3 is an enlarged fragmentary view of a portion of the shield illustrated in FIG. 2.
Figure 4:
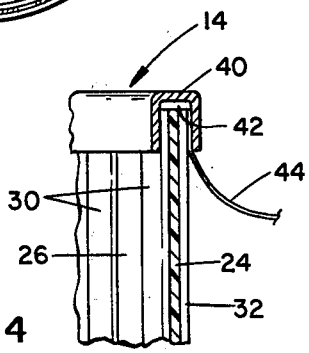
FIG. 4 is a fragmentary sectional view of a portion of the shield taken along the line 4—4 of FIG. 3.

With particular reference to FIG. 1, there is illustrated an exploded view of a cathode ray tube 10, a yoke 12 and a radiation shield 14 in accordance with this invention. The cathode ray tube 10 is of conventional construction and includes a cylindrical glass neck 16 and a flared enlarged body section 18 which terminates at a viewing face (not shown). Positioned within the neck 16 of the tube 10 are the various elements (not shown) which comprise the internal structure of a conventional cathode ray tube. The elements are connected to a plug 20 formed into the end of the neck 16. The plug 20 includes an array of pins 22 positioned to mate with a socket (not shown) which supplies the necessary voltage potentials and video control signal to the tube elements. As mentioned, the video control signal within the tube 10, neck 16 generates electromagnetic radiation which varies in accordance with the information to be displayed. The internal surface of the flared section 18 of the tube 10, in accordance with conventional practice, is coated with a thin layer of bonded graphite which serves to collect secondary electron emission from the beam. This coating provides some radiation shielding.

The shield 14 includes a cylindrically shaped sleeve 24 of mylar or other suitable thin insulating material. The length of the sleeve 24 is sufficient to extend along the neck 16 from the plug 20 to the flared section 18 of the tube 10. The sleeve 24 has an inner surface 26 and an outer surface 28. Bonded to the inner surface 26 are a plurality of elongated, parallel, equally spaced, first, conductive elements 30 each of which extends along the full length of the sleeve 24. Similarly, bonded to the outer surface 28 are a plurality of elongated, parallel, equally spaced, second, conductive elements 32 which extends along the full length of the sleeve 24. Preferably, the conductive elements 30, 32 are fabricated of a non-magnetic electrically conductive material such as copper or aluminum. As illustrated, the first conductive elements 30 on the inner surface 26 of the sleeve 24 are parallel to the second conductive elements 32 on the outer surface 28 of the sleeve 24 and parallel to the axis of the sleeve 24. The elements 30, 32 are offset and the spacing between the first and second conductive elements is slightly less than the width of the elements so that the elements 30, 32 on the inner 26 and outer 28 surface of the sleeve 24 form a continuous covering around the sleeve 24, thus providing an effective electromagnetic radiation shield for the neck 16 of the tube 10. The sleeve 24 has an inside diameter slightly greater than the diameter of the neck 16 of the tube 10 thus allowing the sleeve 24 to fit over the neck 16 of the tube 10.

A suitable shield 14 may be formed from a sheet of double sided flexible printed circuit board material. Such circuit board material includes a thin sheet of mylar with sheets of thin copper foil bonded on both sides thereof. The desired element patterns are then imprinted on the surface of the sheet with suitable resist and thereafter the exposed copper is etched away in a manner well known in the art. The sheet of etched circuit material is rolled into a cylinder and the longitudinal ends secured together with suitable adhesive.

As shown, one end of the sleeve 24 is fitted with a conductive ring 40 preferably of non-magnetic material such as copper. The ring 40 defines a circular slit 42 having the same diameter as the sleeve 24. The width of the slit 42 is slightly greater than the maximum thickness of the sleeve 24 so that one end of the sleeve 24 may be conveniently positioned within the slit 42. After positioning, one end of a drain strap 44 is positioned into the slit 42 and the ring 40 is swagged or compressed closing the slit 42 onto the end of the sleeve 24 thus connecting all of the first and second conductive elements 30, 32 on the inner and outer surfaces 26, 28 of the sleeve 24 electrically to the ring 40 and to the drain strap 44. Alternately, the elements 30, 32 and strap 44 may be soldered to the ring 40 or both compression and soldering may be used in combination to obtain a physically, as well as electrically, secure connection.

As previously mentioned, the shield 14 is placed over the neck 16 of the tube 10 and the deflection yoke 12 is positioned over the shield 14 and securely fastened in position. As a final step, a socket (not shown) is connected to the plug 20. The drain strap 44 is secured to a convenient ground potential by the shortest path.

During operation, the shield 14 effectively attenuates the electromagnetic radiation from the tube 16. The frequency of the radiation is relatively high, and thus the effectiveness of the shield 14 improves as the width of the conductive elements 30, 32 are increased. That is, the inductance of each of the elements 30, 32 which is in series with the inductance of the drain strap 44 decreases as the width of each element 30, 32 increases. As previously mentioned, the yoke 12 generates a magnetic field which easily penetrates the shield 14. It is preferable that the width of the elements 30, 32 be very small in relation to the wave length of the yoke's magnetic field to assure that minimal eddy currents will be generated in the conductive elements 30, 32. This relationship assures that a very small portion of the energy of the yoke's 12 magnetic field heats the shield 14. As noted, it is advantageous to provide relatively wide element 30, 32 widths to reduce their inductance at the electromagnetic radiation frequency. However, as the element 30, 32 width increases, the eddy currents generated by the yoke increase and thus a compromise element 30, 32 width must be selected which provides a reasonably low inductance at the electromagnetic frequency radiating from the neck 16 and yet is not so wide as to be heated excessively by any eddy currents generated by the yoke 12. In a particular application, a cathode ray tube raster was produced by a beam video signal in the form of a square wave having a frequency in the vicinity of 21 Mhz and having particularly high third or fifth order harmonics. The horizontal yoke 12 frequency used to deflect the beam horizontally was in the vicinity of 21 KHZ. In this instance, it was found that a shield having first and second conductors 30, 32 of one-eighth inch width was effective in preventing electromagnetic radiation from the neck 16 and yet provided very little attenuation of the magnetic field generated by the yoke 12.

Figure 5:
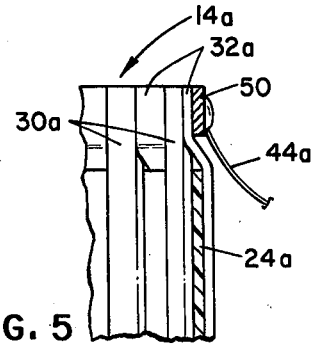
FIG. 5 is a fragmentary sectional view similar to FIG. 3 of a portion of a shield illustrating an alternate embodiment of the invention.

With reference to FIG. 5, an alternate embodiment of a shield **14*a* is illustrated and includes a sleeve 24*a* having first and second elongated, parallel, staggered elements 30*a* and 32*a* bonded to the inner and outer surfaces of the sleeve 24*a* in a manner similar to that described in connection with the previous embodiment. At one end of the sleeve 24*a*, the insulating material of the sleeve 24*a* is removed for a short distance so that the elements project from the sleeve 24*a*. A circular ring 50 of a flat conductive material such as copper is soldered to all of the exposed conductive elements 30*a*, 32*a* and to one end of a drain strap 44*a*. After positioning on the neck of the tube 10, the conductive drain strap 44*a*** is connected to a ground potential as in the prior embodiment.

Although the invention has been particularly shown and described with reference to two embodiments thereof, it will be understood that various changes in form and detail may be made without departing from the scope and spirit of the invention as defined by the following claims.

What is claimed is:

1. An electromagnetic radiation shield (14) adapted for use with a cathode ray tube (10) having a neck (16) wherein means are housed for producing a modulated electron beam deflected within the cathode ray tube (10) by a yoke coil (12) which generates a magnetic field, the radiation shield comprising:

a sleeve (24) of insulating material having inner and outer surfaces and an inner diameter greater than the outer diameter of the neck (16) of the cathode ray tube (10) thus allowing the sleeve (24) to be positioned on the neck (16) of the tube (10), a plurality of first, spaced apart, parallel, conductive, elongated strips of material (30, 32) extending along the inner surface of the sleeve (24) and bonded to the inner surface (26, 28) thereof, a plurality of spaced apart, parallel, second, conductive, elongated strips of material (32) extending along a surface of the sleeve (24) and bonded to the outer surface (28) thereof, said first conductive strips (30) being offset from said second conductive strips (32), and means (40, 42) for electrically connecting one end each of said first and second conductive strips (30, 32) to a ground potential, whereby electromagnetic radiation from the cathode ray tube (10) is highly attenuated and the magnetic field generated by the yoke (12) is allowed to pass through the shield (14) with relatively low attenuation.

2. The radiation shield of claim 1 wherein said first and second elongated conductive strips (30, 32) are oriented with their axes parallel to each other and to the axis of said sleeve (24).

3. The radiation shield of claim 2 wherein said first and second elongated conductive strips (30, 32) are of a non-magnetic material.

4. The radiation shield of claim 3 wherein said connecting means comprises a ring (40) defining a slit (42), said slit (42) having substantially the same diameter as the sleeve (24) and the width of said slit (42) being slightly greater than the total thickness of the sleeve (24) so that one end of the sleeve (24) may be freely positioned into said slit (42) and means for completing an electrical connection between one end of each of said first and second conductive elements (30, 32) and said ring (40).

5. The radiation shield (14) of claim 4 which further comprises a conductive drain strap (44) positioned within said slit (42) and extending therefrom and wherein said slit (42) defined by said ring (40) is compressed so as to securely grasp said first and second conductive elements (30, 32) and said conductive drain strap (44) thereby completing an electrical connection therebetween.

6. The radiation shield (14) of claim 5 wherein said conductive elements (30, 32) are soldered to said conductive ring (40) and wherein said ring is constructed of a non-magnetic material.

7. The radiation shield of claim 3 wherein said first and second conductive elements (30*a*, 32*a*) extend slightly beyond the end of said sleeve (14*a*) and said electrical connection means is in the form of a conductive ring (50) soldered to each of said first and second conductive elements (30*a*, 32*a*) along their extension from said sleeve (14*a*).

8. The radiation shield of claim 7 which further includes a conductive drain strap (44*a*) fastened to said ring (50) providing a convenient means for placing said ring (50) at ground potential.

9. The radiation shield of claims 5 or 8 wherein said conductive elements (30, 32*a*, 32, 32*a*) are approximately one-eighth inch in width.

* * * * *